US011356761B2

(12) United States Patent
Qin

(10) Patent No.: US 11,356,761 B2
(45) Date of Patent: Jun. 7, 2022

(54) MICROPHONE MULTI-CHANNEL INTEGRATED DEVICE

(71) Applicant: Shenzhen Jiahongjing Technology Co., Ltd., Shenzhen (CN)

(72) Inventor: Jingping Qin, Chongqing (CN)

( * ) Notice: Subject to any disclaimer, the term of this patent is extended or adjusted under 35 U.S.C. 154(b) by 0 days.

(21) Appl. No.: 17/213,271

(22) Filed: Mar. 26, 2021

(65) Prior Publication Data

US 2021/0219038 A1 Jul. 15, 2021

(30) Foreign Application Priority Data

Apr. 24, 2020 (CN) ..... 202020639911.X

(51) Int. Cl.
*H04R 1/04* (2006.01)
*H04R 1/08* (2006.01)

(52) U.S. Cl.
CPC ..... *H04R 1/04* (2013.01); *H04R 1/083* (2013.01)

(58) Field of Classification Search
CPC .. H04R 27/00; H04R 29/007; H04R 2420/07; H04R 1/04; H04R 2201/00; H04R 1/2869; H04R 9/063; H04R 27/04; H04R 1/083
See application file for complete search history.

(56) References Cited

U.S. PATENT DOCUMENTS

2018/0332387 A1* 11/2018 You ..... H04R 1/403

* cited by examiner

*Primary Examiner* — Kile O Blair

(57) ABSTRACT

A microphone multi-channel integrated device comprises a speaker body which comprises a main cavity structure. A main cavity speaker, a first auxiliary cavity structural member, a main cavity diaphragm assembly and a second auxiliary cavity structural member are mounted in the main cavity structure through mounting holes. A closed main cavity is defined by the main cavity diaphragm assembly, the main cavity speaker, the first auxiliary cavity structural member, the second auxiliary cavity structural member, an upper main cavity sealing cover, a lower main cavity sealing cover and the main cavity structure. Closed auxiliary cavities are defined by the first auxiliary cavity structural member, the second auxiliary cavity structural member and corresponding auxiliary cavity speakers. Sounds are made mellow and rich by means of the three cavities, and the symmetrical arrangement of parts can reduce squeaking of a microphone caused by resonance.

5 Claims, 4 Drawing Sheets

MICROPHONE MULTI-CHANNEL INTEGRATED DEVICE

BACKGROUND OF THE INVENTION

1. Technical Field

The invention relates to the technical field of microphone and speaker integrated machines, in particular to a microphone multi-channel integrated device.

2. Description of Related Art

The microphone is an energy converter for converting acoustic signals into electrical signals, and the speaker is an audio system for making sounds of electrical equipment.

A microphone and speaker integrated device is a device that integrates the microphone and the speaker.

The speaker of existing microphone and speaker integrated devices has only sound cavity, which leads to a poor acoustic quality. In addition, the speaker of the existing microphone and speaker integrated devices will exert an influence on the microphone when vibrating to make sounds, which compromises the sound amplifying effect of the microphone and results in squeaking of the microphone.

BRIEF SUMMARY OF THE INVENTION

To overcome the defects of the prior art, the objective of the invention is to provide a microphone multi-channel integrated device.

To fulfill the above objective, the invention adopts the following technical solution:

A microphone multi-channel integrated device comprises a speaker body, and a microphone and a handle arranged at an upper end and a lower end of the speaker body, wherein a PCB and a battery electrically connected to the PCB are arranged in the handle, the speaker body comprises a main cavity structure, mounting holes are formed in four side walls of the main cavity structure, respectively, a main cavity speaker, a first auxiliary cavity structural member, a main cavity diaphragm assembly and a second auxiliary cavity structural member are embedded in the mounting holes, respectively, the first auxiliary cavity structural member is symmetrical with the second auxiliary cavity structural member, the main cavity speaker is symmetrical with the main cavity diaphragm assembly, a plane where the first auxiliary cavity structural member and the second auxiliary cavity structural member are located is perpendicular to a plane where the main cavity speaker and the main cavity diaphragm assembly are located, auxiliary cavity speakers are mounted on the first auxiliary cavity structural member and the second auxiliary cavity structural member, the main cavity diaphragm assembly comprises a main cavity diaphragm and a sealing structural member for fixing the main cavity diaphragm, an upper end and a lower end of the main cavity structure are sleeved with an upper main cavity sealing cover and a lower main cavity sealing cover, respectively, a closed main cavity is defined by the main cavity diaphragm assembly, the main cavity speaker, the first auxiliary cavity structural member, the second auxiliary cavity structural member, the upper main cavity sealing cover, the lower main cavity sealing cover and the main cavity structure, closed auxiliary cavities are defined by the first auxiliary cavity structural member and the corresponding auxiliary cavity speaker as well as by the second auxiliary cavity structural member and the corresponding auxiliary cavity speaker, and the main cavity speaker and the two auxiliary cavity speakers are all electrically connected to the PCB.

Furthermore, the microphone comprises a support frame fixing member mounted on the upper main cavity sealing cover, a transducer support frame is mounted on the support frame fixing member, a transducer is mounted on the transducer support frame and is sleeved with a transducer cover, and the transducer is electrically connected to the PCB.

Furthermore, a charging jack and an earphone jack are arranged on the PCB.

Furthermore, a button circuit board is further arranged in the handle, a plurality of functional buttons are arranged on the button circuit board, button caps corresponding to the functional buttons are mounted on a shell of the handle, and the button circuit board is electrically connected to the PCB.

Furthermore, the main cavity structure is sleeved with a housing, and the upper main cavity sealing cover and the lower main cavity sealing cover are both buckled on the housing.

By adoption of this solution, the invention has the following beneficial effects: the closed main cavity and the two symmetrical auxiliary cavities that are separately closed are formed by means of a reasonable structural design, and the three independent cavities make sounds emitted by multiple speakers in different directions mellow and rich and realize a strong sense of depth of deep-bass sounds; the first auxiliary cavity structural member is symmetrical with the second auxiliary cavity structural member and the main cavity speaker is symmetrical with the main cavity diaphragm assembly, such that vibration energy generated when sounds are made can be counteracted to realize a vibration elimination effect, and vibrations can be prevented from being transmitted to the transducer; and the plane where the first auxiliary cavity structural member and the second auxiliary cavity structural member are located is perpendicular to the plane where the main cavity speaker and the main cavity diaphragm assembly are located, and the transducer is located exactly at the central point of the two perpendicular planes, such that squeaking caused by resonance and contact conduction transmitted from the cavities to the transducer can be weakened to the maximum extent.

DETAILED DESCRIPTION OF THE INVENTION

Figure 1:
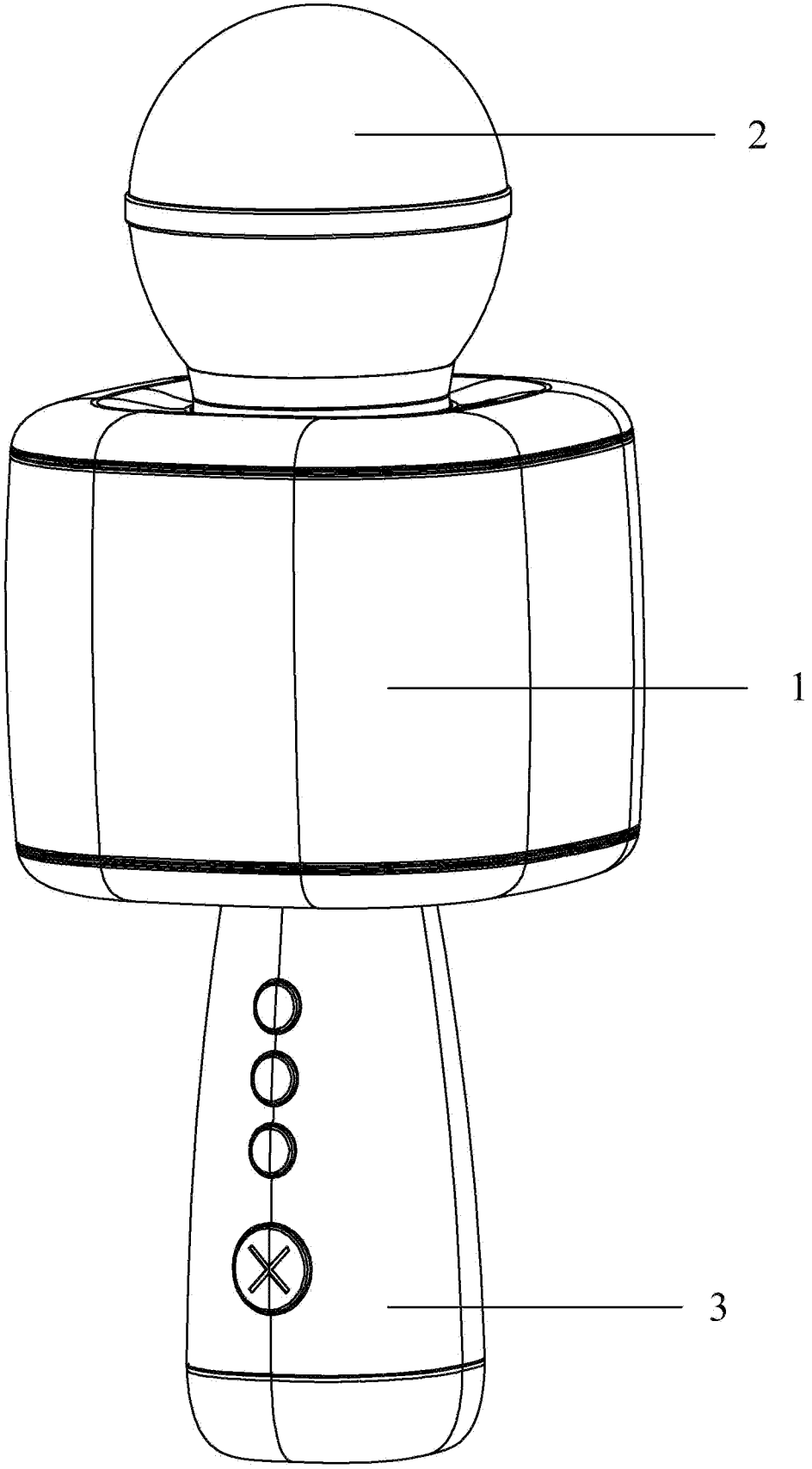
FIG. 1 is a perspective view of one embodiment of the invention.
Figure 2:
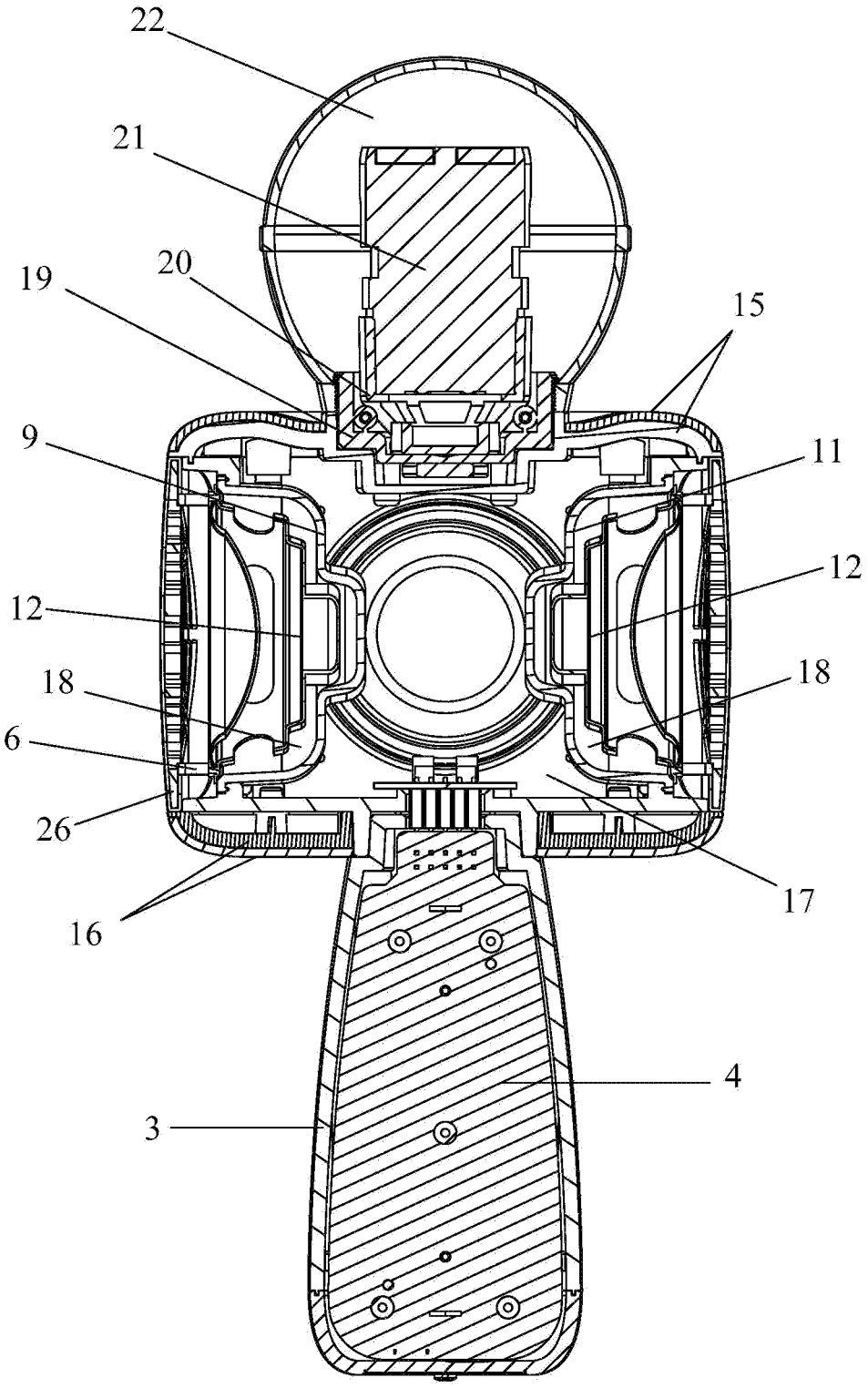
FIG. 2 is a sectional view of one embodiment of the invention.
Figure 3:
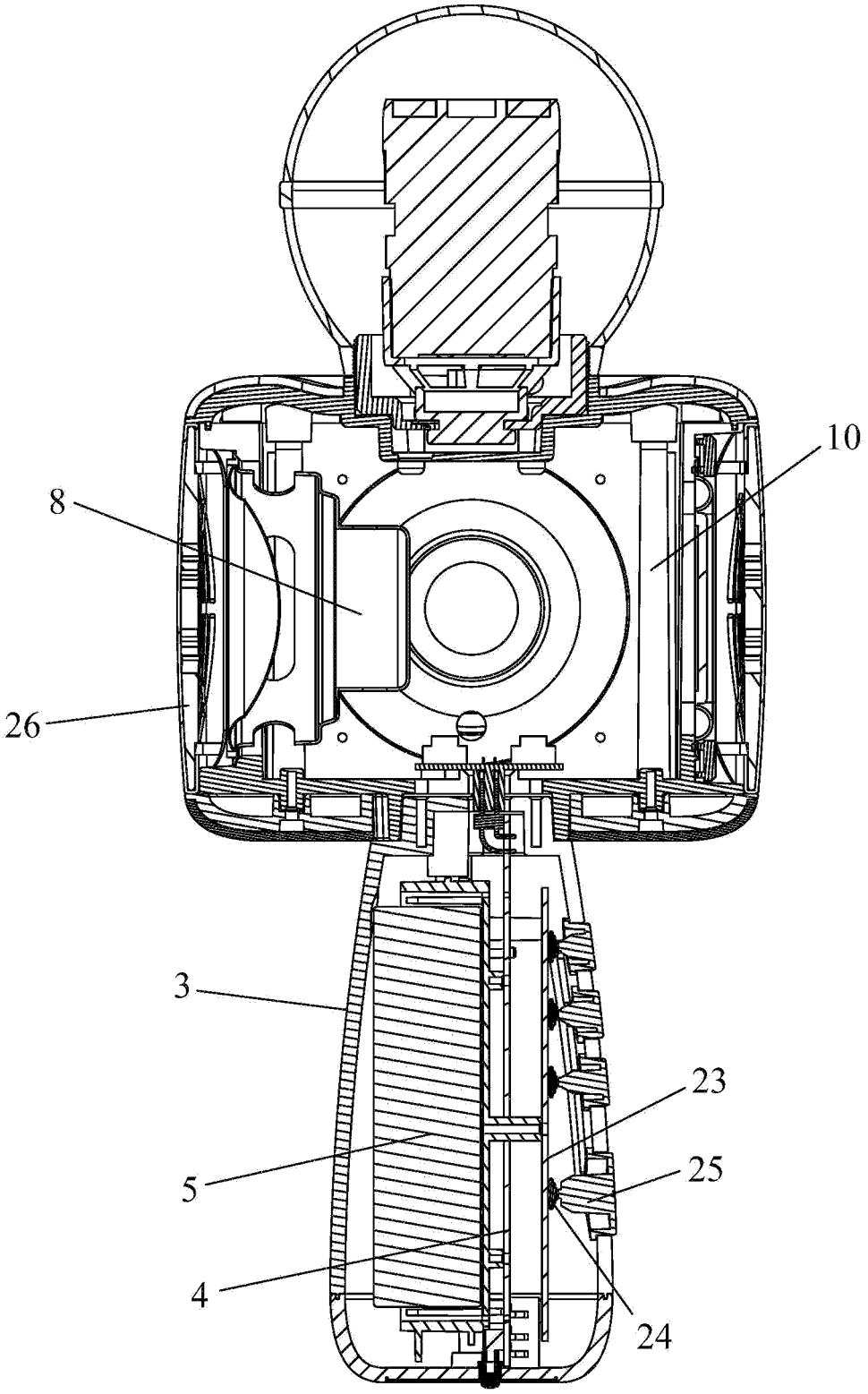
FIG. 3 is a sectional view of one embodiment of the invention, in a direction perpendicular to the sectional view in FIG. 2.
Figure 4:
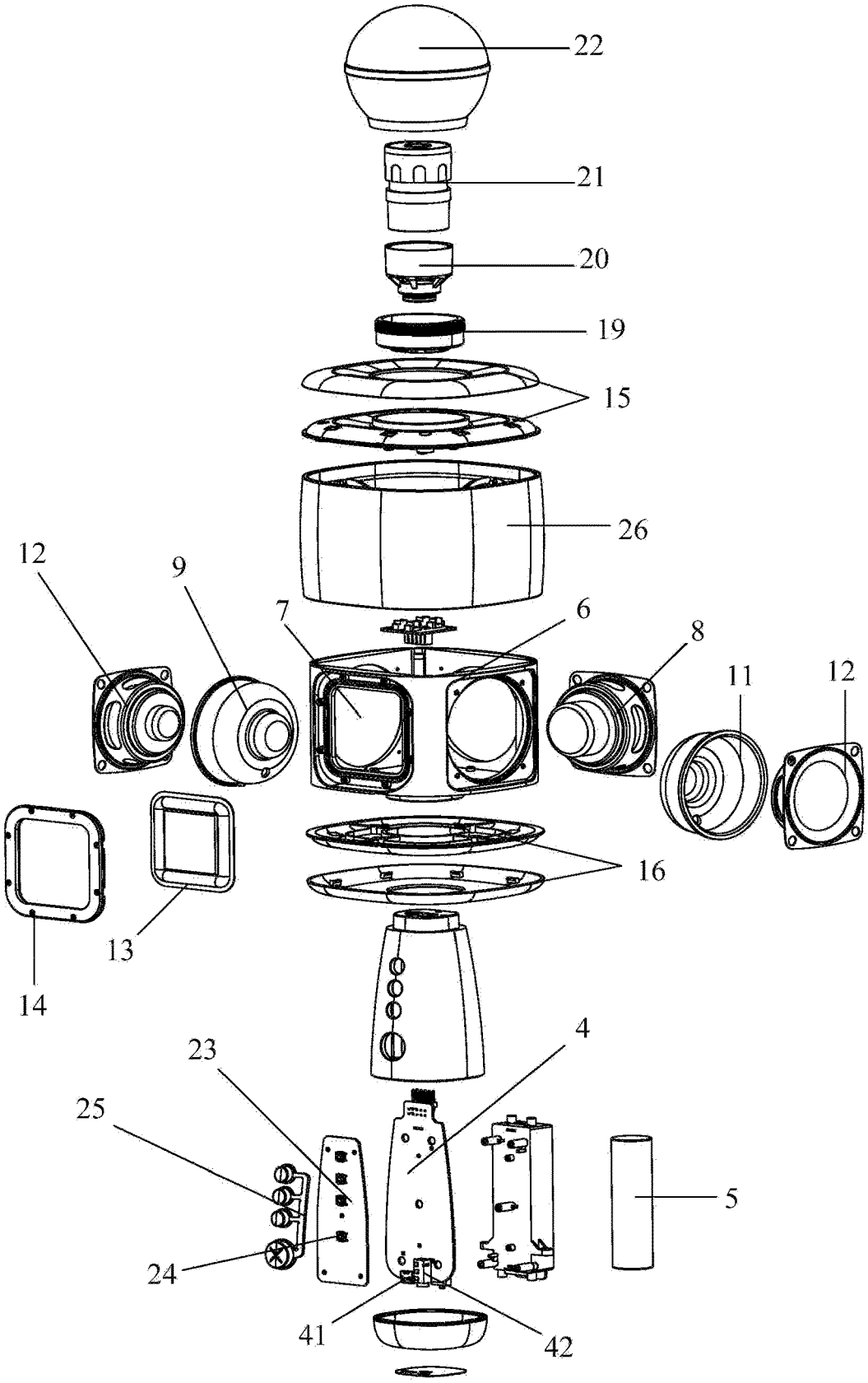
FIG. 4 is an exploded view of one embodiment of the invention.

The embodiments of the invention will be described in detail below in conjunction with the accompanying drawings. Clearly, the invention can be implemented in different manners defined and covered by the claims.

As shown, a microphone multi-channel integrated device comprises a speaker body 1, and a microphone 2 and a handle 3 arranged at an upper end and a lower end of the speaker body 1, wherein a PCB 4 and a battery 5 electrically connected to the PCB 4 are arranged in the handle 3, the speaker body 1 comprises a main cavity structure 6, mounting holes 7 are formed in four side walls of the main cavity structure 6, respectively, a main cavity speaker 8, a first auxiliary cavity structural member 9, a main cavity diaphragm assembly 10 and a second auxiliary cavity structural member 11 are embedded in the mounting holes 7, respectively, the first auxiliary cavity structural member 9 is symmetrical with the second auxiliary cavity structural member 11, the main cavity speaker 8 is symmetrical with the main cavity diaphragm assembly 10, a plane where the first auxiliary cavity structural member 9 and the second auxiliary cavity structural member 11 are located is perpendicular to a plane where the main cavity speaker 8 and the main cavity diaphragm assembly 10 are located, auxiliary cavity speakers 12 are mounted on the first auxiliary cavity structural member 9 and the second auxiliary cavity structural member 11, the main cavity diaphragm assembly 10 comprises a main cavity diaphragm 13 and a sealing structural member 14 for fixing the main cavity diaphragm 13, an upper end and a lower end of the main cavity structure 6 are sleeved with an upper main cavity sealing cover 15 and a lower main cavity sealing cover 16, respectively, a closed main cavity 17 is defined by the main cavity diaphragm assembly 10, the main cavity speaker 8, the first auxiliary cavity structural member 9, the second auxiliary cavity structural member 11, the upper main cavity sealing cover 15, the lower main cavity sealing cover 16 and the main cavity structure 6, closed auxiliary cavities 18 are defined by the first auxiliary cavity structural member 9 and the corresponding auxiliary cavity speaker as well as by the second auxiliary cavity structural member 11 and the corresponding auxiliary cavity speaker, and the main cavity speaker 8 and the two auxiliary cavity speakers 12 are all electrically connected to the PCB 4.

According to the microphone multi-channel integrated device, the closed main cavity 17 and the two symmetrical auxiliary cavities 18 that are separately closed are formed by means of a reasonable structural design, the main cavity 17 is provided with the main cavity speaker 8 and the main cavity diaphragm 13 which are arranged symmetrically, and the two auxiliary cavities 18 are formed in two symmetrical ends of the main cavity 17 and are provided with the corresponding auxiliary cavity speakers 12, such that three cavities that are mutually independent are formed, sounds emitted by multiple speakers in different directions are mellow and rich, and a strong sense of depth of deep-bass sounds is realized;

Mutual resonance and interference will be caused by multiple speakers both in high-pitch sounds and low-pitch sounds. The microphone multi-channel integrated device is provided with the two symmetrical auxiliary cavity speakers 12 to avoid resonance of sounds, better reflect the acoustic quality and eliminate noises, thus providing better experience for users.

The two separately sealed auxiliary cavities are symmetrical, such that an air flow, produced when the auxiliary cavity speakers 12 work, can resonate to increase the volume of high-pitch sounds to eliminate standing waves and solve the problem of acoustic short circuits of left and right channels with respect to the speakers; and the vertical diaphragm is pushed by an air flow at an opening of an acoustic baffle to enhance low-pitch sounds.

The microphone 2 comprises a support frame fixing member 19 mounted on the upper main cavity sealing cover 15, a transducer support frame 20 is mounted on the support frame fixing member 19, a transducer 21 is mounted on the transducer support frame 20 and is sleeved with a transducer cover 22, and the transducer 21 is electrically connected to the PCB 4. The transducer support frame 20 is made of silica gel that can reduce the influence of vibrations, generated when the microphone makes sounds, on the transducer 21.

A charging jack 41 and an earphone jack 42 are arranged on the PCB 4, the charging jack 41 allows a charging cable to be plugged therein to charge the battery 5, and the earphone jack 42 allows an earphone data cable to be plugged therein.

A button circuit board 23 is further arranged in the handle 3, a plurality of functional buttons 24 are arranged on the button circuit board 23, button caps 25 corresponding to the functional buttons 24 are mounted on a shell of the handle 3, and the button circuit board 23 is electrically connected to the PCB 4.

The main cavity structure 6 is sleeved with a housing 26, and the upper main cavity sealing cover 15 and the lower main cavity sealing cover 16 are both buckled on the housing 26.

The above embodiments are merely preferred ones of the invention and are not intended to limit the scope of the patent of invention, and all equivalent structures or equivalent process transformations made according to the contents in the specification and drawings of the invention, or direct or indirect applications to other relating technical fields should also fall within the protection scope of the patent of invention.

What is claimed is:

1. A microphone multi-channel integrated device, comprising a speaker body, and a microphone and a handle arranged at an upper end and a lower end of the speaker body, wherein a PCB and a battery electrically connected to the PCB are arranged in the handle, the speaker body comprises a main cavity structure, mounting holes are formed in four side walls of the main cavity structure, respectively, a main cavity speaker, a first auxiliary cavity structural member, a main cavity diaphragm assembly and a second auxiliary cavity structural member are embedded in the mounting holes, respectively, the first auxiliary cavity structural member is symmetrical with the second auxiliary cavity structural member, the main cavity speaker is symmetrical with the main cavity diaphragm assembly, a plane where the first auxiliary cavity structural member and the second auxiliary cavity structural member are located is perpendicular to a plane where the main cavity speaker and the main cavity diaphragm assembly are located, auxiliary cavity speakers are mounted on the first auxiliary cavity structural member and the second auxiliary cavity structural member, the main cavity diaphragm assembly comprises a main cavity diaphragm and a sealing structural member for fixing the main cavity diaphragm, an upper end and a lower end of the main cavity structure are sleeved with an upper main cavity sealing cover and a lower main cavity sealing cover, respectively, a closed main cavity is defined by the main cavity diaphragm assembly, the main cavity speaker, the first auxiliary cavity structural member, the second auxiliary cavity structural member, the upper main cavity sealing cover, the lower main cavity sealing cover and the main cavity structure, closed auxiliary cavities are defined by the first auxiliary cavity structural member and the corresponding auxiliary cavity speaker as well as by the second auxiliary cavity structural member and the corresponding auxiliary cavity speaker, and the main cavity speaker and the two auxiliary cavity speakers are all electrically connected to the PCB.

2. The microphone multi-channel integrated device according to claim 1, wherein the microphone comprises a support frame fixing member mounted on the upper main cavity sealing cover, a transducer support frame is mounted on the support frame fixing member, a transducer is mounted on the transducer support frame and is sleeved with a transducer cover, and the transducer is electrically connected to the PCB.

3. The microphone multi-channel integrated device according to claim 1, wherein a charging jack and an earphone jack are arranged on the PCB.

4. The microphone multi-channel integrated device according to claim 1, wherein a button circuit board is further arranged in the handle, a plurality of functional buttons are arranged on the button circuit board, button caps corresponding to the functional buttons are mounted on a shell of the handle, and the button circuit board is electrically connected to the PCB.

5. The microphone multi-channel integrated device according to claim 1, wherein the main cavity structure is sleeved with a housing, and the upper main cavity sealing cover and the lower main cavity sealing cover are both buckled on the housing.

* * * * *